US006079647A

United States Patent [19]

Leduc et al.

[11] Patent Number: 6,079,647

[45] Date of Patent: Jun. 27, 2000

[54] PLANT MATERIAL PROCESSING SYSTEM

[75] Inventors: Philip J. Leduc; Leslie G. Hill; David H. Kelly, all of Humboldt; Mark A. Stratton, Saskatoon, all of Canada

[73] Assignee: Durafibre Inc., Canora, Canada

[21] Appl. No.: 09/032,903

[22] Filed: Mar. 2, 1998

Related U.S. Application Data

[63] Continuation-in-part of application No. 08/986,225, Dec. 5, 1997, Pat. No. 5,906,030, which is a continuation of application No. 08/685,453, Jul. 19, 1996, Pat. No. 5,720,083.

[51] Int. Cl.[7] ..... B02C 19/12

[52] U.S. Cl. ..... 241/73; 19/24; 19/30; 241/80; 241/81; 241/101.2; 241/189.1

[58] Field of Search ..... 19/30, 24, 5 R; 241/73, 80, 97, 81, 189.1, 101.2

[56] References Cited

U.S. PATENT DOCUMENTS 2,418,694 4/1947 Brooke .

*Primary Examiner*—Mark Rosenbaum
*Attorney, Agent, or Firm*—Fitch, Even, Tabin & Flannery

[57] ABSTRACT

A system for processing plant material is provided which separates plant fibers from the woody portions of the material to produce a commercially desirable length of fiber and to grind the shorter woody portions that have been separated from the longer fibers to a desirable size which has found use in certain commercial applications. The current system is well suited to process the tough fibers of the North American strain of flax straw, and will also find utility in processing other bast fibers, such as jute, hemp, ramie, and kenaf.

7 Claims, 9 Drawing Sheets

FIG. 5
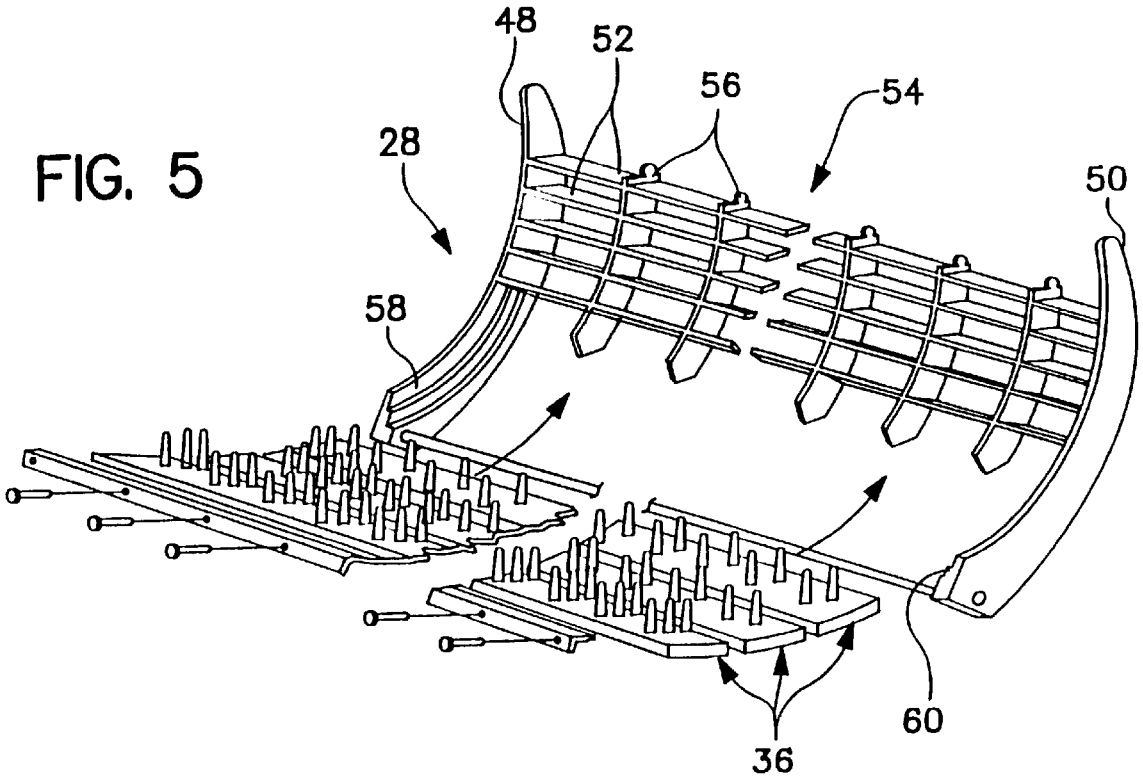
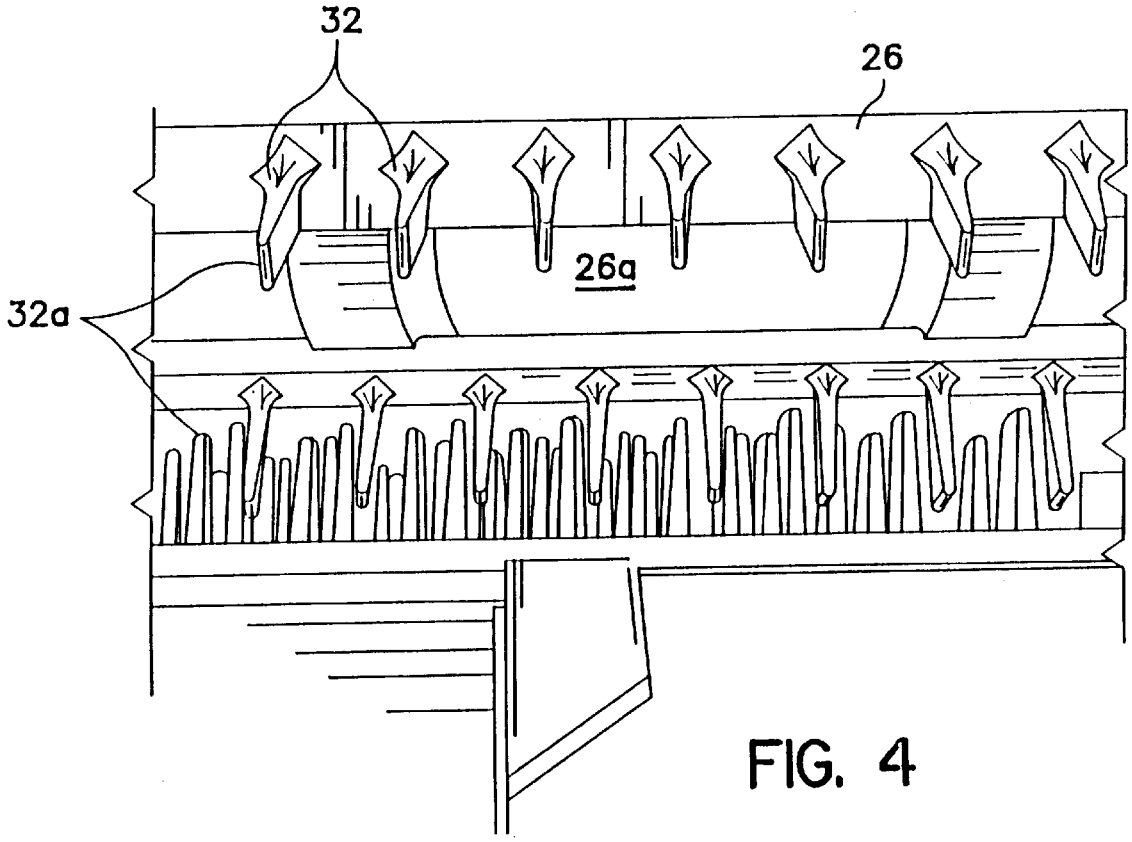
FIG. 4

PLANT MATERIAL PROCESSING SYSTEM

CROSS-REFERENCE TO RELATED APPLICATION

This application is a Continuation-In-Part of patent application entitled APPARATUS FOR DECORTICATING PLANT MATERIAL, Ser. No. 08/986,225, filed Dec. 5, 1997, now U.S. Pat. No. 5,906,030 which, in turn, is a Continuation of patent application entitled METHOD FOR DECORTICATING PLANT MATERIAL, Ser. No. 08/685,453, filed Jul. 19, 1996 now U.S. Pat. No. 5,720,083.

FIELD OF THE INVENTION

The invention relates to a system for processing plant material, and more particularly, to a system that separates fibers and woody portions of the plant material.

BACKGROUND OF THE INVENTION

It has long been known that the bast fibers of various plant materials, e.g. flax, jute, hemp, ramie, kenaf, have particular utility in a wide variety of textile and industrial uses. Accordingly, many different types of machines have been used to process the material for separating the bast fibers of the plant material from the woody portions thereof. For example, machines that utilize a scutching or beating or flailing action as the primary mechanism to break-up the woody material for dislodging it from associated fibers are well-known in the art.

A problem arises with the above-referenced processes in that they can tend to undesirably damage or shorten the fibers as they are being separated from the woody portions of the plant material and thereby yield a product that has fibers that are shortened beyond their optimum length for maximizing their commercial value. This is a particular problem in processing flax that is harvested for its seeds to produce linseed oil such as grown in North America. The North American strain of flax straw is a shorter plant that matures earlier so that it is cheaper to grow than the longer strains of flax straw which are specifically grown for fiber production, such as in Europe. Accordingly, processing flax straw, particularly of the North American strain requires that the woody portions or shive be separated from the flax fibers without a substantial shortening of the flax fibers given the short length of the flax straw to begin with. However, the equipment employed for this process is typically not specifically designed to handle the short North American strain of flax straw and generally causes too much shortening of the fiber rendering it less desirable for many commercial applications and difficult to process in terms of separating out the shive therefrom. Because of this, in most instances where the flax plant is cultivated for its oilseed in North America, there is no attempt made to process the flax to obtain the fibers therefrom. In 1996 in Canada alone, 2.2 million acres of flax straw were grown. As only approximately 10–20% of this acreage of flax was used for paper processing, it can be seen that there is a huge amount of untapped flax fiber that is not currently being used because of the above-described processing limitations.

The stalk of the flax plant has about 30–40% long outer bast fibers and 60–70% short woody inner core fibers or shives. The shives are left as a by-product when the flax material is processed to separate the fibers therefrom. Accordingly, the majority of the flax plant is left as a low-cost reject that is disposed of without any appreciable commercial gain such as by supplying it to farmers for livestock bedding, or for piling it along treelines as biomass to mix with soil and for stopping weed growth. In this regard, sale of shive material only takes in around $9 per ton. Shive has also been used in some board making, and pulp and paper applications.

The size of the shive separated by flax processing equipment from the fibers thereof can vary widely from small to large pieces of shive. In most current applications for shive, the size of the shive is not critical such that the variations in shive sizes as produced by current flax processing equipment are not an issue. On the other hand, applicants have found that shive that is ground to a fine, consistent size can be used in polymer composite applications as either a filler or a reinforcement additive. As opposed to most current applications where shive is utilized, the size of the shive can be critical in composite applications making the consistency of the small shive particles important.

Thus, it can be seen that there is a need for a plant material processing system, and particularly one that processes the short, tough North American strain of flax grown for its oilseed, that is effective to separate the fibers from the shive thereof without undesirably damaging and shortening the fibers. Further, there is a need for a processing system which can take the shive separated from the flax fibers and reduce it to a very fine, consistent size which has found particular utility in composite applications.

SUMMARY OF THE INVENTION

In accordance with the present invention, a system for processing plant material is provided which separates plant fibers from the woody portions of the material to produce a commercially desirable length of fiber and to grind the shorter woody portions that have been separated from the longer fibers to a desirable size which, as described, has found use in certain commercial applications. The current system is well suited to process the tough fibers of the North American strain of flax straw, and will also find utility in processing other bast fibers, such as jute, hemp, ramie, and kenaf.

In one form of the invention, a processing system is provided having a plurality of processing sections which separate woody portions from fibers of plant material and for reducing the size of the separated woody portions. These processing sections include a stripping section for exerting a pulling action on the plant material to strip woody portions therefrom while minimizing damage to and shortening of the fibers. Following the stripping section, a cleaning section is provided for separating the majority of the remaining woody portions associated with the plant fibers by scraping of the plant material to obtain a further separation of the remaining woody material for yielding a product that has a very high fiber purity with the scraping action similar to the stripping action, doing minimal damage to the fiber length so that the fibers remain at a length that is commercially valuable. The woody portions are taken from the stripping and cleaning sections and are then subjected to a grinding section which rapidly beats and grinds the woody portions to a small particle size.

The processing system may include a fiber recovery portion that has an oscillating sieve section for shaking and screening any longer fibers which may have dropped or fallen out of the stripping and cleaning sections along with the woody portions so that substantially only woody portions are fed to the grinding section. To ensure a consistent fine size of the woody portions or shive, a rotary screening section can be provided subsequent to the grinding section with the screening section sifting the woody portions to the commercially desired size such as for use in composite applications.

In one exemplary application of the use of the processing system herein, the plant material, e.g. oilseed flax after removal of the seed therefrom, fed to the stripping section has a length in the range of approximately 12–14 inches and the stripping section produces fibers having a length in the range of approximately 6–8 inches. After being subjected to the cleaning section, the fiber length is reduced to be in the range of approximately 4–6 inches. Accordingly, it can be seen that the fibers produced by the present processing system are kept to a length that is approximately between 30 to 50 percent of the original length of the flax straw that is fed into the processing system.

It should be understood that when discussing sizes of the plant material and the various portions thereof that by necessity these should be considered average sizes given the large volume of plant material that the present system processes. Because of the large volume throughput which the present processing system is designed to handle, e.g. on the order of 10,000 lbs of plant material per hour, there are bound to be variations in the sizes of the plant material and its portions that do not fall within the ranges as specified herein. Nevertheless, the majority of this material has been found to fall within the specified ranges despite minor variations therefrom.

Preferably, the stripping section yields a fiber product that is in the range of approximately 55 to 60 percent fiber purity and the fiber product yielded by cleaning section is further purified to approximately 90 percent fiber purity. Thus, unlike prior processing equipment, the system herein yields a very high percentage for fiber purity while at the same time minimizing the damage and consequent shortening of the fibers so that they are at a commercially desirable length as they exit from the present processing system.

The predetermined size of the woody portions produced by the downstream grinding section can be in the range of between approximately 0.125 inch and 0.020 inch. Where the plant material is flax and the grinding section produces shive to the above specified range of sizes, at this fine size the shive is particularly suitable for use in composite applications, as earlier discussed. More particularly, the shive must be at a consistent size because it must be of sufficient size to provide the reinforcing characteristics that may be desired from it when used in a polymer composite but also be sufficiently small for smooth processing in terms of having good mixing characteristics with the polymer resins and proper melt flow characteristics.

Another aspect of the invention is the provision of a cleaning apparatus for receiving decorticated plant material that has a first level of fiber purity, e.g. 55 to 60% fiber purity, and further separating remaining woody portions from fibers in the decorticated material to increase fiber purity to a second higher level of fiber purity, e.g. 90% fiber purity, over the first level. The apparatus includes at least one set of a cylinder and an associated concave member having a predetermined radial spacing therebetween and through which the plant material travels as the cylinder is rotated. Spikes are provided on the cylinder and the concave member that project generally radially therefrom and which are arranged so that the spikes overlap and are spaced laterally from each other as the cylinder is rotated and the spikes thereon pass the spikes on the concave member. Accordingly, as the cylinder spikes carry plant material past the concave member spikes, the material undergoes a scraping action to further remove any remaining woody portions from the fibers without substantial damage thereto. The spikes on the cylinder and the concave member are of a predetermined length that is slightly less than the predetermined radial spacing between the cylinder and concave member to minimize the radial clearance between the distal tips of the spikes and the cylinder and the concave member. By having the spikes extend to a depth close to the respective surfaces of the cylinder and the concave member, the amount of plant material in the lateral spaces between the respective spike members of the cylinder and the concave member undergoing the aforesaid scraping action is maximized.

Preferably, there are five sets of cylinders and associated concave members provided through which the plant material travels.

The concave member can have a grated section that is downstream and circumferentially rearward of the concave member spikes in the plant material travel direction so that after the plant material carried by the cylinder spikes is subjected to the scraping action against the concave member spikes, the plant material travels over the grated section with scrapped off woody portions of the plant material passing through the grated section. The grated section has openings that are at a predetermined size selected to keep the longer fibers from passing through the openings while permitting the shorter scraped off woody portions to pass therethrough.

As is apparent, it is important for the processing equipment to minimize damage to the fibers so that they remain at a sufficient length for passing over the grated section, as otherwise proper sorting of fibers from separated woody portions will not occur potentially adversely affecting the subsequent processing of the plant material. Accordingly, the size of the grate openings is critical for properly sorting the separated woody portions from the fibers for subsequent processing of the woody portions, as will be discussed more fully hereinafter. In this regard, it is also important that the processing equipment utilized upstream from the cylinder and concave member keep the fibers at a proper length so that the scraping action generated by the spikes of the cylinder and concave member do not shorten the fibers beyond their critical length for passing over the grated section.

The spikes of the cylinder and concave member are preferably arranged in rows circumferentially spaced from one another with adjacent rows having spikes that are offset from each other so that the plant material is caused to undergo a back and forth scraping action as it is successively engages concave member spikes in different rows on either side of a particular cylinder spike. In this manner, the material is not continuously scraped along the same portion thereof throughout the spike overlap area and instead alternatively hits the offset spikes in different rows of the concave members at different times with different portions of the plant material to thereby minimize damage to the length of the fibers while still scraping off the woody portions therefrom.

In another form of the invention, a method of producing fibers from plant material is provided. The method includes stripping woody material from fibers of the plant material to produce decorticated plant material at a first level of fiber purity, providing a plant material scraping area defined by cooperating spikes on a cylinder and associated concave member arranged in a set, feeding the decorticated plant material at the first level of fiber purity to the cylinder and concave member set, rotating the cylinder with the spikes thereon passing the spikes on the concave member with lateral spacing therebetween, carrying the decorticated plant material with the spikes on the cylinder to the scraping area by rotation of the cylinder, scraping woody portions of the plant material from the fibers as the plant material engages spikes on the concave member in the scraping area to minimize shortening of the fibers, and producing fibers at a higher level of purity than the first level after scraping and which are at a length that is only slightly shorter than the fibers fed to the scraping area.

The method may include arranging the spikes on the cylinder and concave member in circumferentially spaced axial rows with spikes in adjacent rows having spikes that are offset from each other, and causing the plant material to undergo a back and forth scraping action as the cylinder spikes carry plant material to the scraping area with the plant material successively engaging offset concave member spikes in different rows on the concave member on either side of a particular cylinder spike.

In another aspect of the invention, a rotary grinder for grinding woody portions separated from fibers of plant material is provided. The rotary grinder includes a rotor and a plurality of pivot shafts fixed to the rotor for rotating therewith. A plurality of flailing members are pivotally mounted on each of the pivot shafts. An inlet to the rotary grinder is provided through which woody portions separated from the plant fibers are fed to the grinder. A screen assembly is spaced from the rotor and has outlet apertures at a predetermined size through which the woody portions are screened during operation of the grinder for producing woody portions that are reduced in size by at least 90 percent from when they enter the grinder. A motor drive is provided for high speed rotation of the rotor with the flailing members pivoted out on their pivot shafts to impact against the woody portions for reducing their size until they can pass through the screen outlet apertures. In a preferred form, the predetermined screen opening size is in the range of 0.125 to 0.020 inch. Accordingly, the above grinder produces woody portions or shive that is ground to a fine, consistent size which can be sold for significant commercial gain for use in composite applications.

In one form, the screen assembly includes a substantially rigid support or backing member having openings that are substantially larger in size than the screen assembly outlet apertures. A flexible screen member includes the outlet apertures and is fixed to the rigid support member so that flailed and ground up woody portions first pass through the outlet apertures and then through the support member openings. The above-described construction of the screen assembly is important because at the high-speed rotation of the rotor and with the large amount of woody portions or shive material that are being fed through the inlet of the grinder, there are significant forces developed as the flailing members impact against the shive until they are reduced to a size sufficiently small so that they can pass through the screen outlet apertures. As the screen including the very small sized apertures is flexible, without use of the more rigid backing member, the flexible screen would likely fail under applied forces during operation of the rotary grinder. On the other hand, the screen assembly with the rigid backing member is effective to allow use of the finer flexible screen member for producing the desired size of shive while still processing high volumes of shive material through the grinder.

In another aspect of the invention, a method of producing finely sized woody portions of plant material is provided. The method includes stripping and scraping woody portions from fibers of the plant material, providing a first rotary grinder having a rotor and pivotally mounted flailing members and outlet apertures at a first small predetermined size, feeding the woody portions that have been stripped and scraped from the plant fibers to the first rotary grinder, driving the grinder rotor for high speed rotation so that the flailing members are pivoted out from the rotor, impacting the woody portions with the pivoted out flailing members, and reducing the size of the woody portions to the first predetermined size of the outlet apertures for passing therethrough as an incident of being impacted with the flailing members.

The method may further include providing a second rotary grinder having a rotor and pivotally mounted flailing member and outlet apertures at a second predetermined size that is smaller than the first predetermined size, feeding the reduced size woody portions from the first rotary grinder to the second rotary grinder, driving the second grinder rotor for high speed rotation so that its flailing members are pivoted out from the rotor, and impacting the reduced size woody portions to the second predetermined smaller size of the second grinder outlet apertures for passing therethrough.

In a preferred form, the method further includes providing a rotary cylindrical screen having apertures at a third predetermined size substantially the same or slightly smaller than the second predetermined size of the outlet apertures of the rotary grinder, feeding the reduced size woody portions from the rotary grinder into the cylindrical screen, rotating the cylindrical screen for passing woody portions that are at or below the third predetermined size through the screen, and recirculating woody portions that do not pass through the screen to the first rotary grinder. In this manner, a continuous loop is provided for processing all of the woody portions or shive from the plant material and reducing it to the desired size for commercial sale. With this method, the shive material that was sold for little commercial gain is efficiently processed to the appropriate size without losing shive during the processing stages so that substantially all of the flax plant material is sold for commercial gain.

BRIEF DESCRIPTION OF THE DRAWINGS

FIG. 4 is a front elevational view showing the spikes on the cylinder member arranged in axial rows with spikes in adjacent rows being offset from each other;

FIG. 5 is a perspective view of the concave member showing plates having the spikes in axial rows thereon with spikes in adjacent rows being offset from each other;

DETAILED DESCRIPTION OF THE PREFERRED EMBODIMENT

Figure 1:
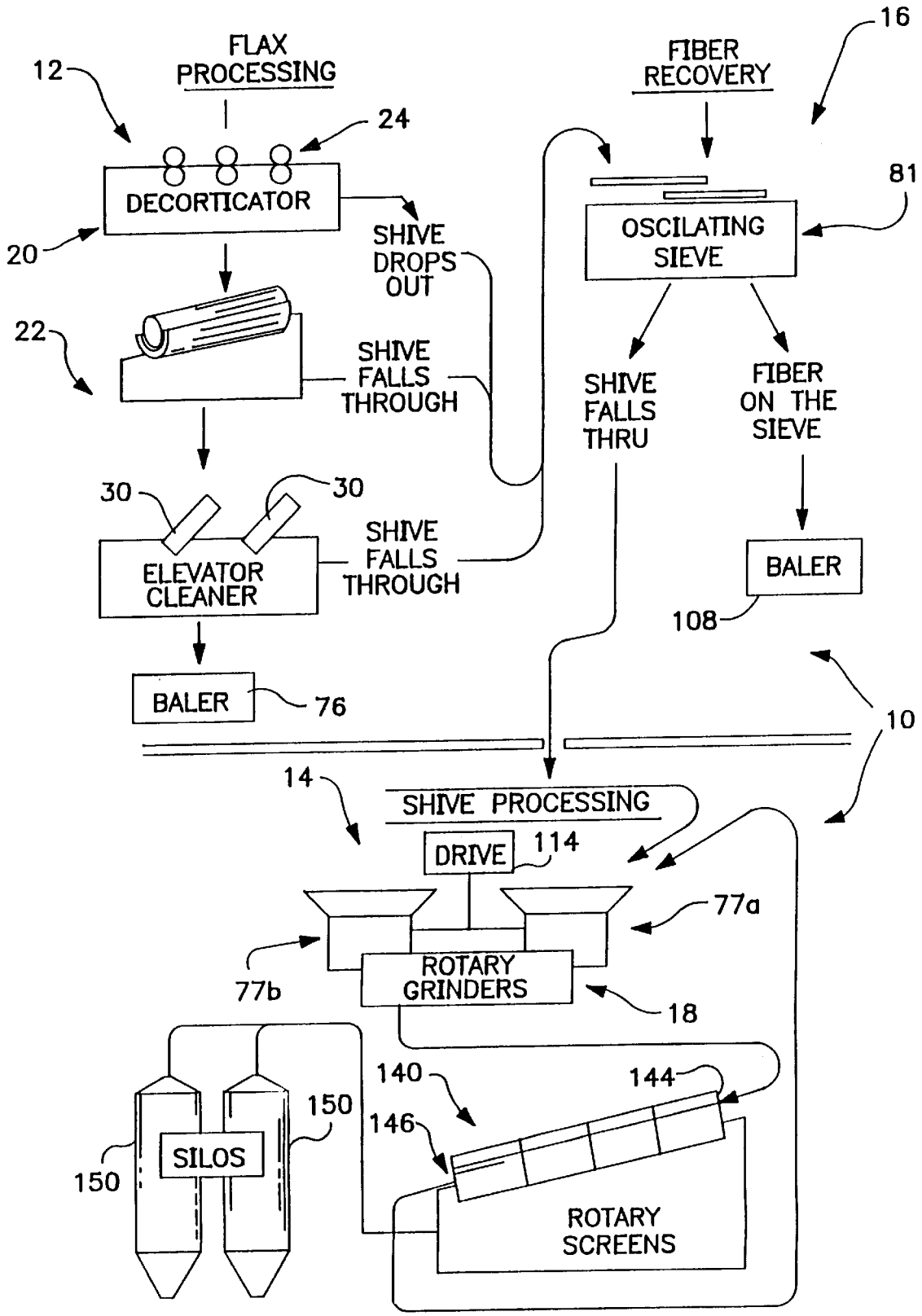
FIG. 1 is a schematic view of a plant material processing system in accordance with the present invention and showing various processing sections thereof.

FIG. 1 depicts a plant processing system generally designated 10 which is designed to process very high-volumes of bast plant material, and preferably the flax straw that is grown in North America for its oilseed, to obtain the fibers therefrom at a commercially desirable length, and to also take the separated woody portions or shives and grind them to a fine, consistent size which can be sold at significantly higher prices, e.g. 100–200 dollars per ton, over prices that are obtained currently for unprocessed separated shives. As shown, the plant or flax fiber processing system 10 includes a main flax fiber processing portion 12 of the system 10 which has processing sections with equipment that is designed to remove most of the fiber from the flax plant material. In the preferred form, the flax processing portion 12 yields a product that has an approximately 90 percent fiber purity.

The processing system 10 also can include a woody or shive processing portion 14 for taking the shive separated in the flax fiber processing portion 12 and reducing its size to the aforementioned fine, consistent size necessary for commercially valuable sales. Further, a fiber recovery portion 16 can be provided preceding the shive processing portion 14 for ensuring that substantially only shive material is fed to grinding section 18 of the shive processing portion 14 and to retrieve any long fibers that may come out of stripping and cleaning sections, 20 and 22, respectively, of flax fiber processing portion 12 of the system 10.

As has been discussed, for commercial reasons it is important to produce long fibers. However, when processing oilseed flax that are shorter than their European counter-part grown specifically for its fiber, it is difficult to separate the shive from the fibers without damaging the fibers and undesirably shortening them beyond what is commercially desirable. Moreover, most flax processing equipment relies on the fact that the shive is heavier than the fibers using gravity to allow separated shives to drop or fall from the equipment with the longer fibers continuing downstream for processing. In this regard, it is also crucial that the fibers maintain their length so that they do not fall through any openings in the equipment along with the heavier separated shive pieces as otherwise a significant portion of the fiber that can be otherwise recovered from the flax straw may be lost. It is also possible, particularly where screening equipment is utilized, to pneumatically draw the material through the screen openings by suction.

Accordingly, applicants have developed the present flax processing system 10 including main flax fiber processing portion 12 thereof which minimizes damage to the flax fibers keeping them at the long length desirable for commercial purposes even when processing the tough, short North American variety of flax which is harvested for its oilseed to produce linseed oil. In this regard, the decorticating method and apparatus described in applicants co-pending applications, Ser. Nos. 986,225 and 685,453, respectively, finds particular utility as used in the stripping section 20 of the flax fiber processing portion 12 of the system 10 herein. As described in these applications that are incorporated herein as if reproduced in their entirety, the stripping section 20 uses sets of fluted rollers 24 only shown schematically in FIG. 1 with sets rotating at progressively increasing operating speeds in the downstream direction. In this manner, a pulling action is exerted on the flax plant material which strips the shive therefrom with little damage caused to the fibers. The decorticating or stripping section 20 is effective to yield a product in the range of approximately 55–60 percent fiber purity and which is fed to the cleaning section 22 with the separated shives dropping out from the stripping section 20 between sets of rollers 24 for further processing, as will be described herein.

The cleaning section 22 takes the product from the stripping section 20 and further purifies it to approximately 90 percent fiber purity, as previously-mentioned. To do this without causing substantial damage to the fibers, sets of cylinders 26 and associated concave members 28 are provided through which the plant material travels, and then to a pair of identical elevator cleaners 30, which will be more fully described hereinafter. The cleaning section 22, and specifically the sets of cylinders 26 and associated concave members 28 are effective to scrape the flax as it is caused to travel therebetween against spikes 32 that are provided thereon. The scraping action is effective to separate the majority of the remainder of shives still attached to the flax fibers without too much shortening of the fibers.

Figure 3:
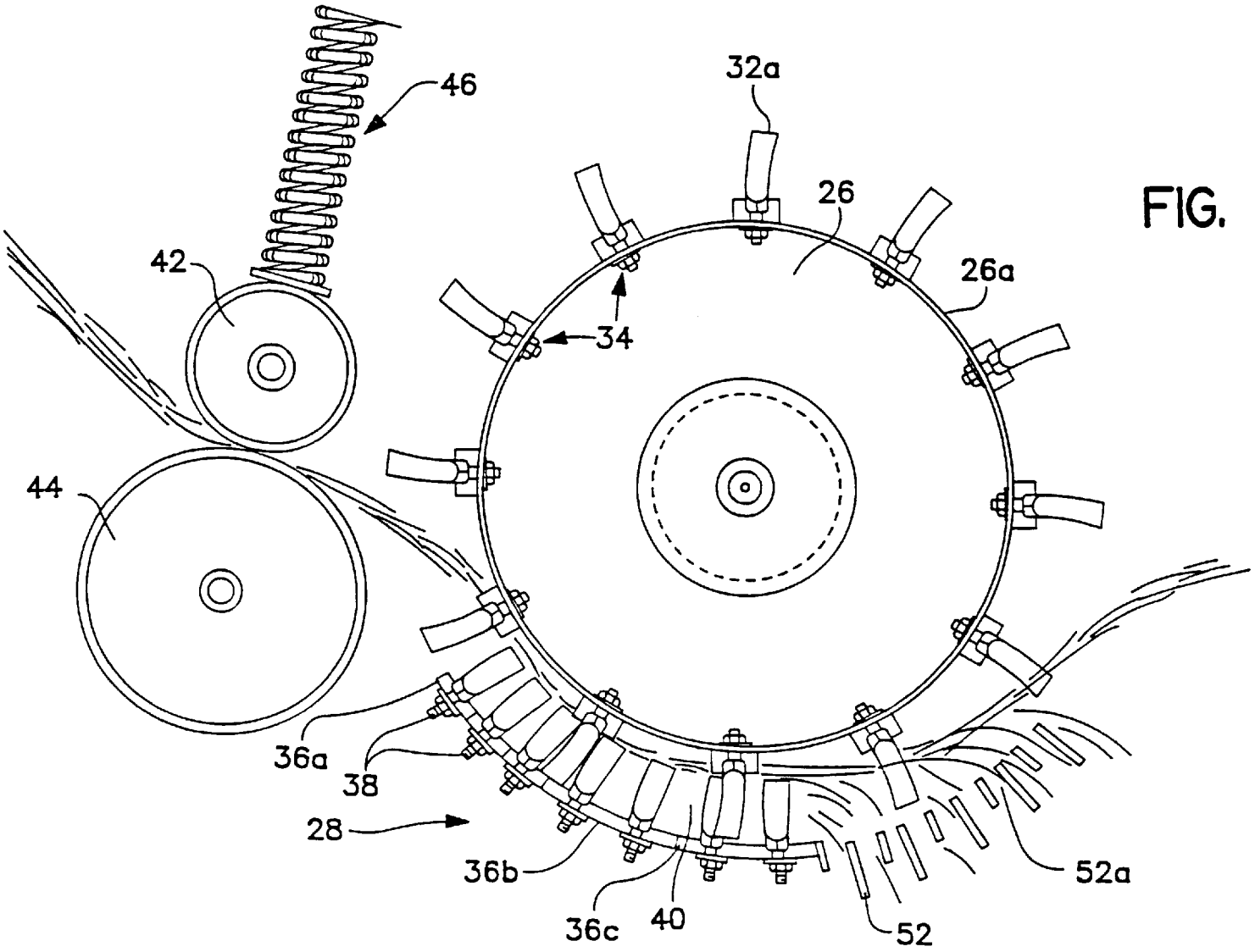
FIG. 3 is an enlarged elevational view of a pair of spring loaded mat forming rollers upstream from a set of a spiked cylinder and associated spiked concave member showing the spikes of the concave member arranged upstream from a downstream grated section thereof.

Referring to FIGS. 3–5, the construction of the cleaning section 22 and particularly the cylinders 26 and concave members 28 thereof will next be described. The spikes 32 of the cylinder 26 are arranged in axial rows that are circumferentially spaced around the cylinder 26 and are fastened thereto as by a bolting arrangement 34. Similarly, the spikes 32 of the concave member 28 are arranged in axial rows that are circumferentially spaced from each other. The concave member spikes 32 can be secured to individual plates 36 as by a bolting arrangement 38. The cylinder 26 and associated concave member 28 are arranged at a predetermined radial spacing from one another with the spikes 32 being sized to extend radially so that distal tips 32*a* of the spikes only have a slight radial clearance from respective facing surfaces 26*a* and 28*a* of the cylinder 26 and concave member 28.

Scraping areas 40 are defined between the cylinders 26 and concave members 28 in which the overlapping spikes 32 thereof are disposed and through which the flax plant material is caused to travel by rotation of the cylinder 26. By having the spikes 32 extend to a depth close to the surfaces 26*a* and 28*a* of the respective cylinders and concave members 28 such that the overlap between the respective spikes 32 is maximized, the amount of plant material kept in the lateral spaces between the overlapping spikes 32 and undergoing the desired scraping action will also be maximized. By way of example, the spikes 32 can be approximately 3 to 3½ inches long with there being approximately a half inch clearance between the spike distal tips 32*a* and the surfaces 26*a* and 28*a*.

Before the flax material is fed to the first cylinder 26 and associated concave member 28, the flax is caused to travel through a pair of crush rollers 42 and 44 for forming a mat of flax material to be fed to the first scraping area 40 as carried by the spikes 32 on the cylinder 26 and to provide protection by removing foreign objects from the flax material. In this regard, the upper roller 32 can be spring loaded as by coil spring 46 so as to form a nip between the upper and lower rollers 42 and 44 through which the plant material is drawn.

For minimizing the damage done to the fibers of the flax material as it travels through the scraping areas 40, the spikes 32 on each of the cylinders 26 and concave members 28 are arranged such that spikes in one row are offset in an axial direction from spikes in an adjacent row. In this manner, as the cylinder 26 is rotated, the flax material carried by a cylinder spike 32 will be scraped against the closest concave member spike 32 immediately adjacent thereto on one lateral side thereof. Continued rotation of the cylinder 26 causes the plant material spaced farther away from the cylinder spike 32 that carries it on both sides of this cylinder spike 32 to be scraped against concave spikes 32 that are equally spaced slightly further apart on either side of the cylinder spike 32. Thereafter, plant material on the other side of the particular cylinder spike 32 will next scrape against the closest concave member spike 32 on that lateral side of the particular cylinder spike 32. Accordingly, at different times as the plant material is being pulled through the scraping area 40 by the cylinder spikes 32, the plant material on one side and/or the other of cylinder spike 32 and at different locations thereon will be undergoing a scraping action against an adjacent concave member spike 32 but not for the entire time the plant material is in the scraping area 40. In this manner, the plant material is caused to undergo a back and forth scraping action on either side of a particular cylinder spike 32 as it is pulled thereby through the scraping area 40.

Figure 6A:
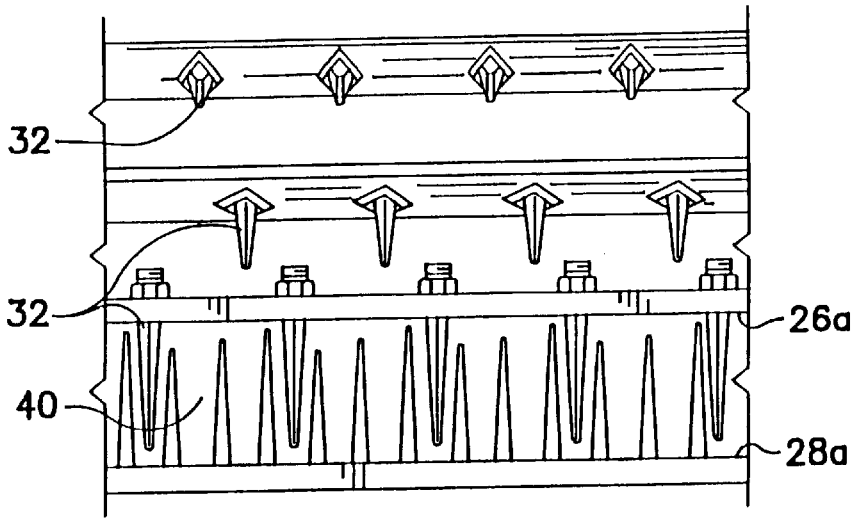
FIGS. 6*a*–6*c* are front elevational views showing successive rows of spikes on the cylinder member being rotated through a scraping area defined by the overlap between the spikes on the cylinder and concave member.
Figure 6B:
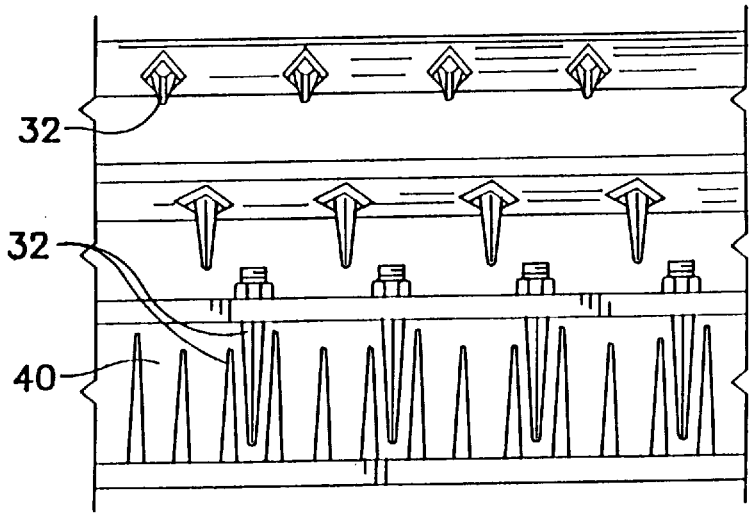
Figure 6C:
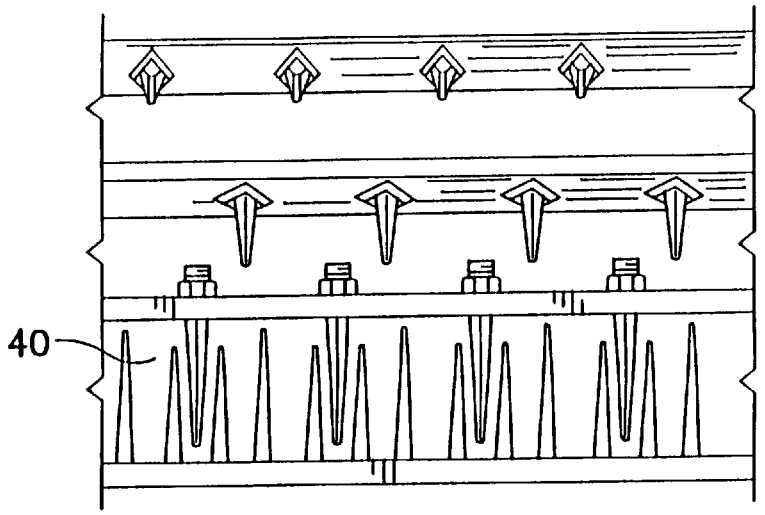
Figure 7:
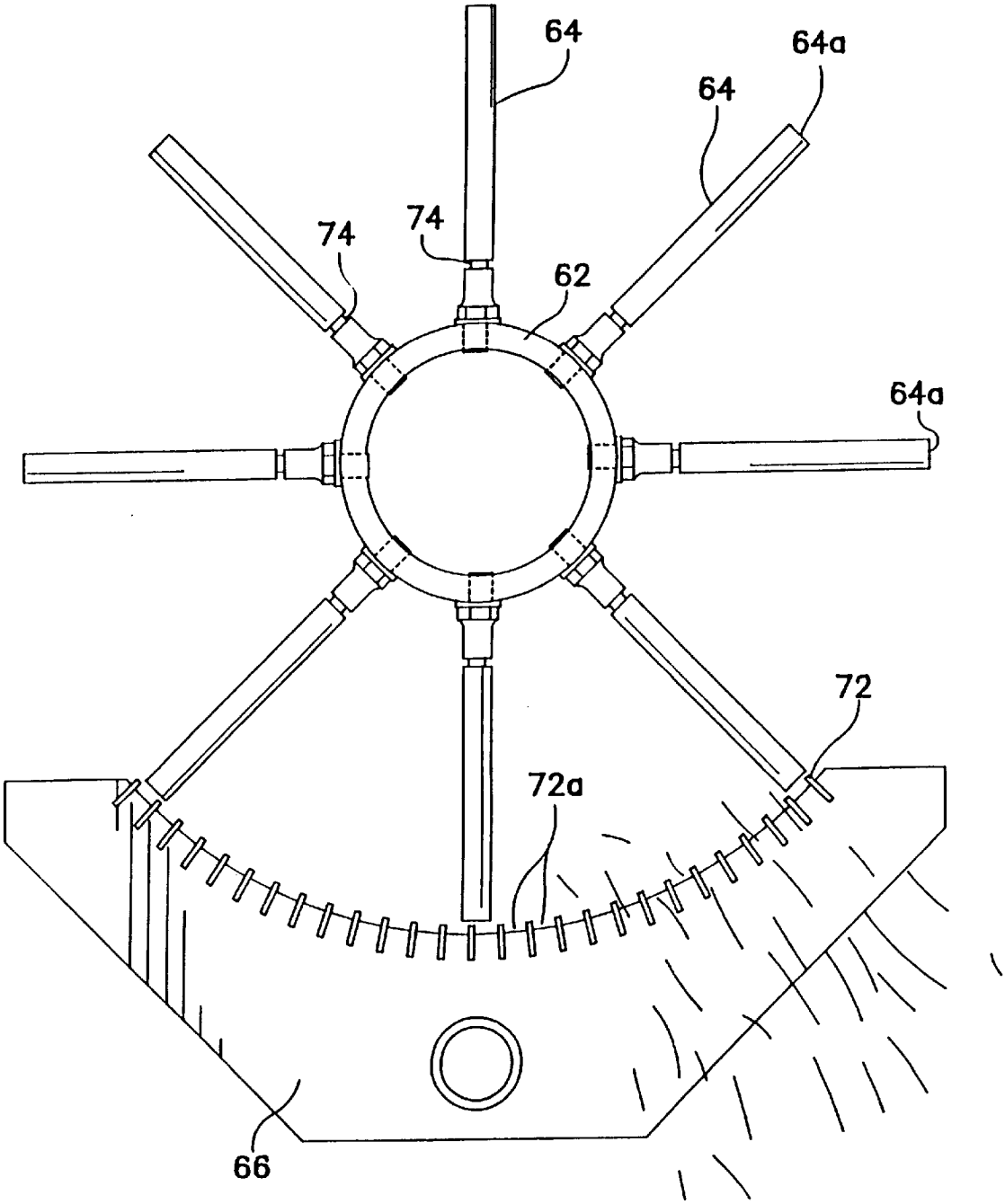
FIG. 7 is an elevational view of one of the rotors and its radial fingers and an associated concave grated member.
Figure 8:
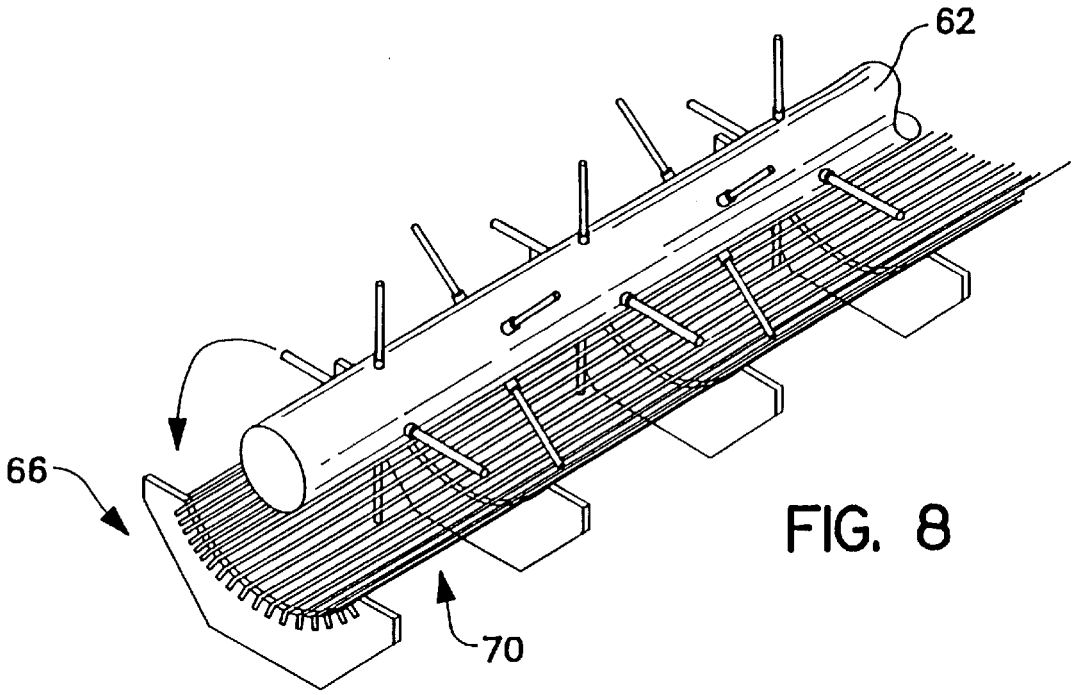
FIG. 8 is a perspective view of the rotor and concave member of the elevator cleaner showing the radial fingers arranged in axial rows with fingers in adjacent rows being offset from each other.

This arrangement of spikes 32 in the scraping area 40 can best be understood by reference to FIGS. 6*a*–6*c*. As can be seen in these figures, the spikes 32 have tapered side surfaces that converge at their distal tips 32*a* so that there is somewhat of a mating arrangement as cylinder spikes 32 are rotated through the scraping area 40 and past concave member spikes 32 on either side thereof. As shown, the cylinder axial rows of spikes 32 can repeat every fourth row in terms of the axial positioning of the spikes 32 in a row. The concave member spikes 32 can be similarly arranged in terms of their axial offset so that they repeat every fourth row. In this regard, FIGS. 6*a*–6*c* show variations in the height of adjacent concave member spikes 32 despite all of the concave member spikes 32 having the same radial length. The variations in height shown in 6*a*–6*c* are because of the different rows in which the spike members 32 are disposed on the concave member 28 with the spikes 32 that appear shorter in height being disposed in rows that are more circumferentially downstream from the taller appearing spikes 32. Accordingly, spikes 32 having the same height are all arranged in the same axially extending row. As such, it can be seen that the concave member spikes 32 like the cylinder spikes 32 repeat every fourth axial row in terms of their axial position within a row.

As previously discussed, the concave member spikes 32 are provided on individual plates 36. The plates 36 are adapted to be mounted to arcuate frame members 48 and 50. The concave member frames 48 and 50 are interconnected by transverse bars 52 which cooperate to form a grated section 54 that is circumferentially rearward or downstream from the concave member spikes 32 and the plates 36 to which they are mounted. The circumferential spacing of the transverse bars 52 of the grated section 54 is carefully selected so that the openings 52*a* formed therebetween are especially adapted for use in the flax processing system 10 herein. More specifically, the spacing 52*a* between the transverse bars 52 of the grated section 54 is selected to keep longer fibers that are scraped from the flax material in the scraping area 40 from falling through the openings 52*a* while permitting the shorter scraped off shive to fall therethrough. Preferably, the grate openings or spaces 52*a* between grate bars are sized to be on the order of approximately one half of an inch for the present processing system 10.

For providing strength to the grate bars 52 so they do not flex during operation of the system 10 herein and to assist in travel of the longer lighter fibers of the flax material over the grate bars 52, several circumferentially extending support or guide bars 56 can be attached between the bars 52 with the guide bars 56 being axially spaced from each other, as shown in FIG. 5. In this manner, the lighter fibers which tend to wad or clump together can more readily be pulled over the grated section 54 by the cylinder spikes 32 with the heavier pieces of shive separated from the fibers falling through the grate openings 52*a* between the grate bars 52, as shown in FIG. 3.

To mount the plates 36 with the concave member spikes 32 thereon, the frame members 48 and 50 have channel rails 58 and 60, respectively, formed on their facing inner sides so that the plates can be slid into position between the members 48 and 50 on the rails 58 and 60. In the preferred and illustrated form, three such plates 36 are provided with the first or upstream plate 36*a* having three rows of offset spikes 32 thereon and downstream plates 36*b* and 36*c* having two such offset rows of spikes 32 thereon. With the upstream plate 36*a* bolted or clamped in place relative to the frame members 48 and 50, the downstream plates 36*b* and 36*c* will be held and captured in place on the rails 58 and 60. Should less of a scraping action be desired, the scraping area 40 can be altered as by removing one of the plates 36 and replacing it with a blank, such as one of the plates 36 with the spikes 32 unbolted and removed therefrom. In this manner, the concave member 28 affords the option of adjusting the precise scraping action that the plant material undergoes in the scraping area 40.

Figure 2:
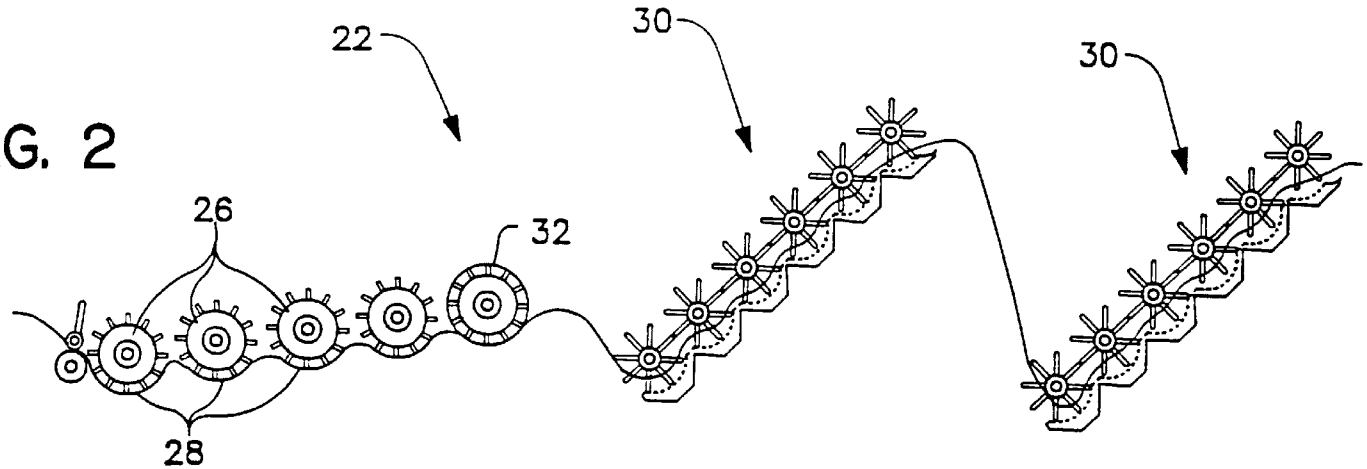
FIG. 2 is an elevational view showing five sets of spiked cylinders and concave members followed by a pair of elevator cleaners each including six sets of rotors having finger projections extending radially therefrom.

In the preferred form, the cleaning section 22 is provided with five sets of cylinders 26 and associated concave members 28 through which the plant material travels with downstream cylinders 26 and concave members 28 being slightly vertically higher than the preceding, upstream cylinder 26 and concave member 28, as can be seen in FIG. 2. The cylinder 26 is rotated at a predetermined speed that causes the material to travel through the scraping area 40 and out past the grated section 54 at a threshold speed that is sufficient to deliver it to the next cylinder 26 and associate concave member 28 downstream therefrom by the momentum imparted thereto by the immediately upstream cylinder 26. It has been found that rotation of the cylinder 26 at approximately 500 to 1100 rpms where the cylinder 26 is approximately 30 inches in diameter provides the material with sufficient momentum for being delivered to an adjacent downstream cylinder 26 while keeping a long fiber length and providing a high throughput for the large volume of flax material that the present system 10 is designed to process. The cylinder 26 and concave member 28 can be similar to that used in the 9600 John Deere combine used for processing rice with modifications as described above so that they are adapted for use in the present flax plant processing system 10, and particularly the flax fiber processing portion 12 thereof.

After the flax plant material has exited from the last set of cylinder 26 and associated concave member 28, it is fed to the pair of elevator cleaners 30 which exact a further separation of any loose shive pieces in the material that has been processed through the scraping areas 40. Each elevator cleaner 30 can include several rollers or rotors 62 which have very long radially extending fingers or rods 64 that are bolted or otherwise rigidly secured thereto and project radially therefrom so that there is only a slight clearance between their distal tips 64*a* and concave members 66. The concave members 66 each include a grated section 70 thereof formed by axially extending grate bars 72 that are circumferentially spaced to form grate openings 72*a* therebetween. Similar to the grated portion of the concave member 28, the grate openings 72*a* are sized to permit only the short shive pieces to pass therethrough with the longer fibers being carried by the fingers 64 for travel thereover. Preferably, the grate openings or spaces 72*a* between grate bars 72 are sized to be on the order of approximately one half of an inch. The fingers 64 are arranged in axial rows with fingers 64 in adjacent rows being axially offset from each other. As shown, the rows of fingers 64 preferably repeat every other row. The fingers 64 act to pick the flax material and drag it over the grated section 70 thereby dislodging any loose shive from the longer plant fibers.

The fingers or rods 64 can be provided with an annular grove 74 adjacent their rigid attachment to the rotor 62. The grooves 74 allow the fingers 64 to break thereat if the fingers 64 encounter excessive force such as could occur if can excessive amount of flax fibers wad together. Instead of the wadded flax fibers being pushed against the concave grated section 70 and potentially bending and damaging this part of the elevator cleaner 30, the break-away grooves 74 cause failure in only the stressed fingers 64 which can be easily replaced versus the concave members 66. Further, this allows the elevator cleaner 30 to continue to function properly without varying the small radial clearance, e.g. on the order of 0.025 inches, through which the plant material travels.

As shown, each elevator cleaner 30 preferably has six sets of rotors 62 and concave members 66 that are arranged at increasing vertical heights with respect to the immediately upstream rotors 62 and concave members 66 so that the elevator cleaner 30 causes the plant material to travel at a pitch of approximately 45° upward until it exits therefrom. By way of example, the rotors 62 can have a 6⅝ inch diameter with the fingers 64 being approximately 8 inches long. To provide the flax material with sufficient momentum for feeding to an upstream rotor 62 and concave member 66, the rotors 62 can be rotated in the range of 100 to 700 rpms, and most preferably are rotated at approximately 500 rpms.

After the plant material has been processed through the cleaning section 22 including, in the preferred form, the five sets of spiked cylinders 26 and associated concave members 28, and then the two elevator cleaners 30 each including six sets of rotors 62 and concave members 66, the product yielded therefrom will be at approximately 90 percent fiber purity while at the same time keeping the fiber length at the size necessary for commercial use despite the relatively tough and small size of the oilseed flax straw which the system 10 processes. After the fiber leaves the final downstream elevator cleaner 30, it is conveyed to a baler 76 where it is baled and stored.

As previously discussed, applicants have found that the shive by-product from the decorticating and cleaning systems 20 and 22 that is ground to a predetermined fine size can be of significant commercial use and value. Accordingly, the shive that drops out between the sets of fluted rollers 24 from the decorticator and the shive that falls through the grated portions 54 and 70 is collected for further processing, as can be seen in FIG. 1. The shive processing portion 14 of the system 10 preferably utilizes a pair of rotary grinders 77 which rapidly beat and grind the shive to a fine size for passing through very small apertures 80 formed in a screen assembly 78 of each of the grinders 77. Because of the extremely small size of the outlet apertures 80 (FIG. 12) of the screen assembly 78 for the rotary grinders 77, it is necessary that any of the lighter flax that may have dropped out of the decorticator 20 or fallen through the grated sections 54 and 70 be removed before feeding to the grinder section 18 to avoid clogging of the fine screen apertures 80.

Figure 10:
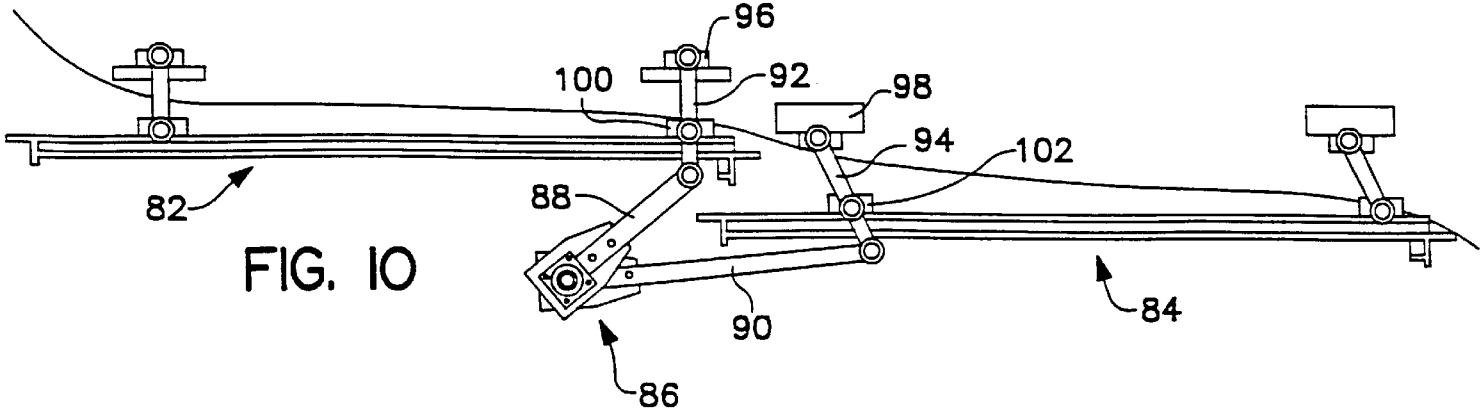
FIG. 10 is a side elevational view of the oscillating sieve section of FIG. 9 showing a pair of sieves and a drive mechanism for oscillating the sieves.

Accordingly, a fiber recovery portion 16 is preferably provided after the main flax processing portion 12 and before the shive processing portion 14 of the present flax material processing system 10. The fiber recovery portion 16 of the system 10 has a sieve section 81 utilizing a pair of oscillating sieves 82 and 84 such as taken from a 8800 John Deere grain combine. The sieves 82 and 84 include a drive mechanism 86 that is effective to oscillate the sieves 82 and 84 in equal and opposite directions. The drive mechanism 86 includes a pivot link 88 associated with the upstream and vertically higher sieve 82 and a pivot link 90 associated with the vertically lower downstream sieve 84, as best seen in FIG. 10. As shown, the pivot links 88 and 90 are pivotally attached to respective pivot mounting bars 92 and 94 at one of the ends thereof with the mounting bars 92 and 94 being pivotally mounted to fixed mounting blocks 96 and 98 at their other ends for the sieves 82 and 84, respectively. The mounting bar 92 is fixed to the downstream end 100 of sieve 82 intermediate pivotally mounted ends of the mounting bar 92. The mounting bar 94 is fixed to the upstream end 102 of sieve 84 intermediate pivotally mounted ends of the mounting bar 94.

Drive shaft 104 of the drive mechanism 86 is connected to the pivot links 88 and 90 eccentrically so that it drives the pivot links 88 and 90 in an orbital back and forth path which causes the horizontal sieve 82 and 84 to oscillate both horizontally and vertically in a 2:1 ratio so that for every two inches the sieves 82 and 84 are caused to move horizontally, they are cause to move one inch vertically. In addition, the oscillating movements of the sieves 82 and 84 are coordinated so that they move in equal and opposite directions at the same time such that if sieve 82 is moving back in an upstream direction, the sieve 84 is moving forward in a downstream direction; and if sieve 82 is moving vertically downward, sieve 84 is moving vertically upward. In a like manner, if the sieve 82 is moving in a downstream direction, the sieve 84 will be moving back in an upstream direction; and if sieve 82 is moving vertically upward, the sieve 84 will be undergoing a vertically downward motion. The opposite oscillating movements of the sieves 82 and 84 tend to cancel out one another in terms of the momentum imparted to the plant material thereon thus keeping it on the screen surfaces of the sieves 82 and 84 for a longer period of time for screening out the heavier shive in the flax plant material through the sieves 82 and 84 as they are being oscillated. In this manner, the oppositely oscillating sieves 82 and 84 serve to shake loose the separated shive material from the flax fibers which tend to clump together as a consequence of the shaking action and thus will not fall through the sieves 82 and 84 so that substantially only shive is delivered to shive processing portion 14 of the present flax processing system 10.

For screening the longer fibers from the shorter shive portions, the sieves 82 and 84 each include a plurality of rows of baffles 106 that can be adjusted to change the size of the openings therebetween. The baffles 106 are preferably inclined slightly in the downstream direction to assist in travel of the flax fibers thereover. As the sieve 82 is swung forwardly in the downstream direction by the drive mechanism 86, the flax fibers are thrown downstream toward the sieve 84 with a portion of the fibers transferring thereto. Similarly, as the sieve 84 is swung forwardly in the downstream direction by the drive mechanism 86, the fibers will be thrown downstream with a portion exiting therefrom. The sieves 82 and 84 generally do not have the throughput capacity of the cleaning section cylinders 26 and associated concave members 28, or of the elevator cleaners 30; however, the sieves 82 and 84 have been found to work particularly well in the fiber recovery portion 16 of the system 10 as the throughput can be significantly lower in this portion of the system 10.

After the longer and clumped together fibers that remain on these sieves 82 and 84 exit from the downstream end of sieve 84, the fiber is conveyed to a baler 108 for being baled and stored. The shive that is sifted and falls through the baffles 106 of the sieves 82 and 84 is conveyed to the grinding section 18 of the shive processing portion 14 of the plant material processing system 10.

Figure 11:
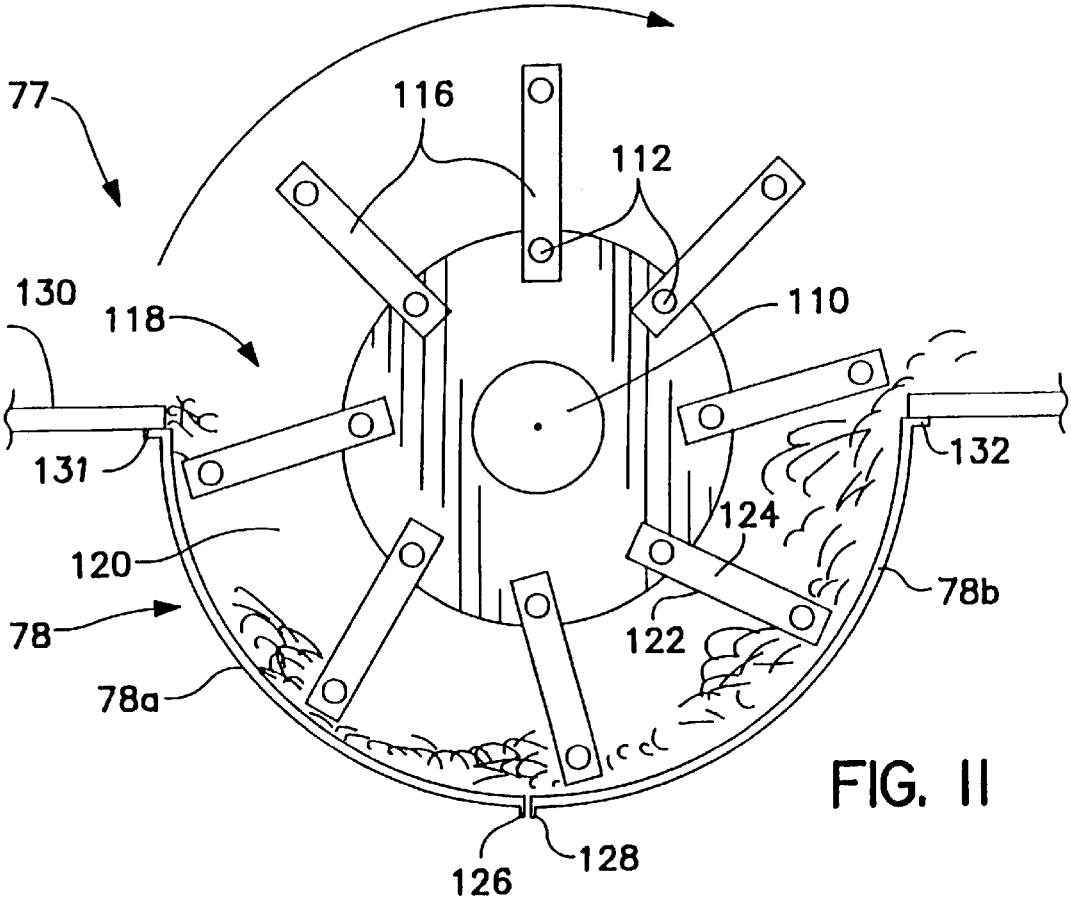
FIG. 11 is an elevational view of one of the rotary grinders of a shive processing portion of the plant processing system showing flailing members pivoted out to impact against separated woody portions of the plant material reducing their size to fall through a screen assembly below the rotor.
Figure 9:
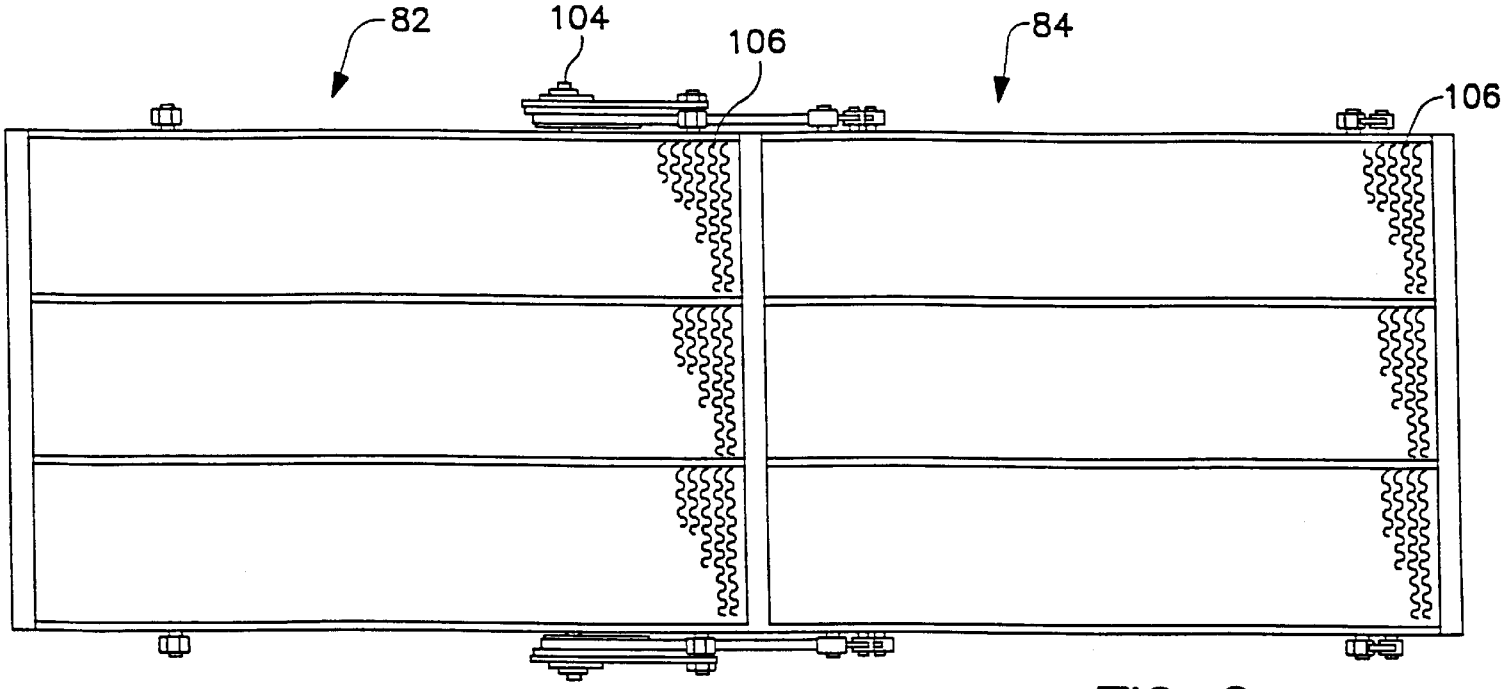
FIG. 9 is a top plan view of an oscillating sieve section of a fiber recovery portion of the plant material processing system.

As previously mentioned, the rotary grinder section 18 preferably includes a pair of rotary grinders 77. The grinders 77 each include a rotor 110 with a plurality of pivot shafts 112 fixed to the rotor 110 thereabout so that as the rotor 110 is driven for high-speed rotation by rotor drive 114, the pivot shafts 112 will rotate therewith. The pivot shafts 112 each pivotally mount a plurality of flailing members 116. During high-speed rotation of the rotor 110, the flailing members 116 are pivoted out on their respective shafts 112 due to centrifugal force so as to extend generally radially out from their pivot shafts 112 and thus rotor 110, as can be seen in FIG. 11. The rotary grinders 77 can be modified forms of Haybuster H-1000 hammermills that are uniquely designed for use in the shive processing portion 14 of the present plant processing system 10 by way of the previously-described screen assembly 78 having the finely sized apertures 80 for producing a very small, predetermined size of shive as output therefrom.

More specifically, the rotary grinders 77 are fed with shive that is screened through the oscillating sieves 82 and 84 by way of a hopper (not shown) and into inlet 118 to impact area 120 through which the flailing members 116 travel adjacent the screen assembly 78. Preferably, each rotary grinder 77 has approximately 80 flailing members 116 each being approximately 8 inches long. The flailing members 116 are provided with a relatively thin edge 122 that serves to impact against the shive and break and grind it down to the fine size necessary for passing through the outlet apertures 80 of screen assembly 78. In this regard, the preferred flailing members 116 have opposite side faces 124 that have a thickness therebetween along the leading edge 122 of approximately three-eighths of an inch. The outlet apertures 80 can be in the range of approximately 0.0125 inch down to 0.020 inch. Where the flax straw material that is being fed to the processing system 10 herein is of the North American strain, and is on average 12 to 14 inches in length, it has been found that after being subjected to the flax processing portion 12 and fiber recovery portion 16 of the processing system 10, the shive pieces have an average size on the order of approximately 2 inches when fed through the inlet 118 to the first rotary grinder 77. Thus, it can be seen that the grinder 77 must break shive down for passing through apertures 80 in the preferred range of sizes to a size that is less than 10 percent of their average size as fed to the first grinder 77*a*. In other words, the grinder 77 must reduce the size of the shive by over 90 percent from their average size as yielded by the sieve section 81.

To accomplish this task, the drive 114 drives the rotors 110 for high-speed rotation that is preferably in the range of approximately 2000 to 3000 rpms. As is apparent, at this high-speed of rotation with the large volume of shive that is being fed through the inlet 118 and that must pass through the very small outlet apertures 80 of the screen assembly 78, there will be extremely high forces generated in the impact area 120 by both the rapid air and the rapid shive material movements in the impact area 120. This requires that the screen assembly 78 be sufficiently robust for withstanding these forces while also being effective to screen the ground up shive to the necessary fine size for use in the previously-described composite applications.

Figure 12:
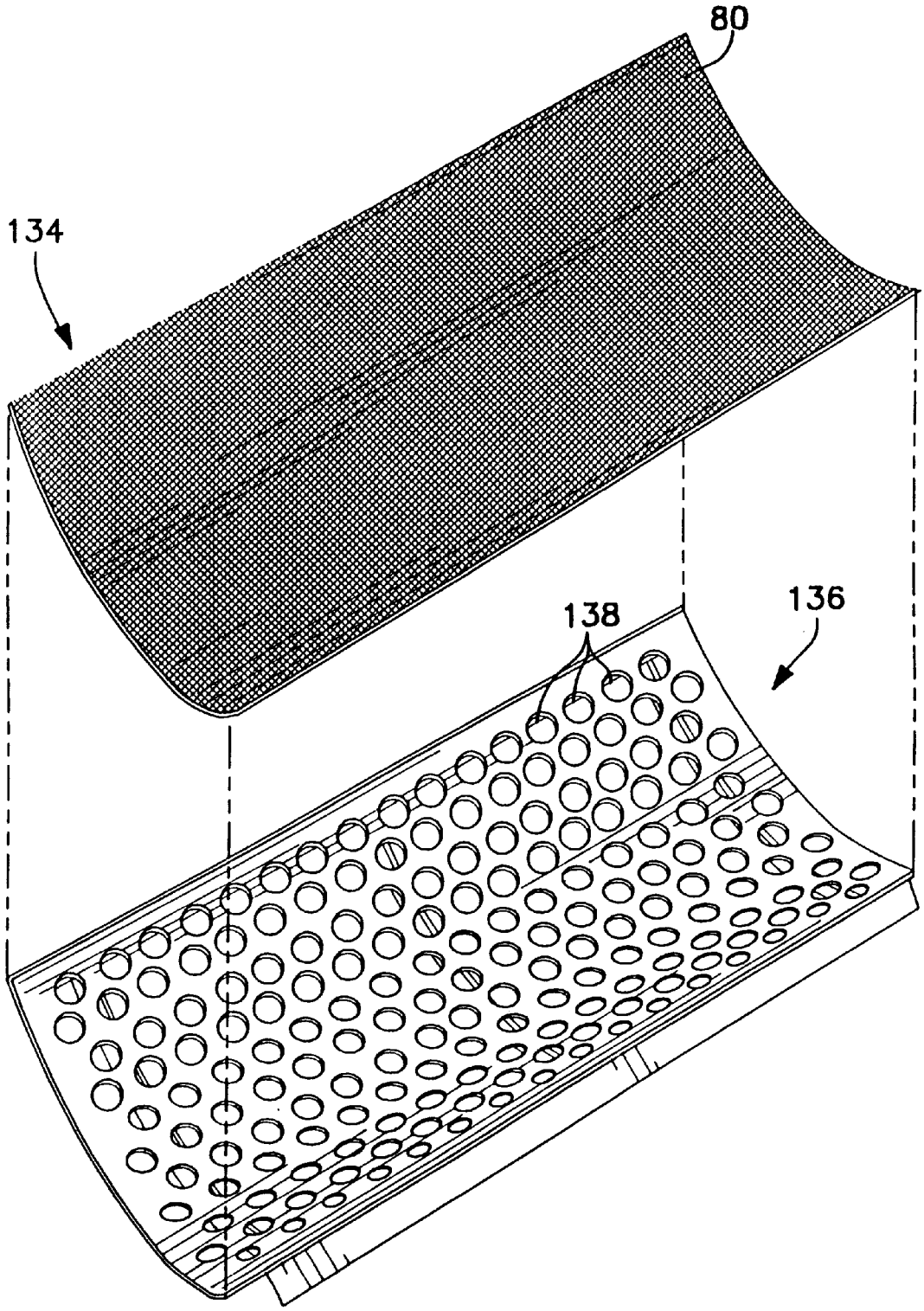
FIG. 12 is an exploded perspective view of a portion of the screen assembly of the rotary grinder of FIG. 11 showing a finely apertured flexible screen member and a substantially rigid support therefor having relatively large openings formed therein.

As can be seen in FIG. 11, the screen assembly 78 extends substantially 180° around the bottom of the rotor 110 and includes two identically constructed portions 78*a* and 78*b* thereof which are fastened together by respective flanges 126 and 128 at their bottoms. At their tops, the screen assembly portions 78*a* and 78*b* are fastened to the underside of floor panel 130 of the grinder 77 by way of respective flanges 130 and 132 provided thereon. Referring to FIG. 12, the robust screen assembly 78 herein includes a flexible screen member 134 including the small outlet apertures 80 formed therein and a substantially rigid backing or support member 136 which has much larger openings 138 formed therein relative to the apertures 80 of flexible screen member 134. For example, with the previously specified range of sizes for the apertures 80, the openings 138 of the backing member 136 can be approximately 2 inches in diameter. In this regard, the screen used in current Haybuster H-1000 hammermills can be modified for use as the backing member 136 so that it can be secured to flexible screen member 134. Thus, with the flexible screen 134 secured to the backing member 136, a portion 78*a* or 78*b* of the robust screen assembly 78 is provided which will withstand the high force generated by the high-speed rotation of the grinder rotor 110 with the flailing members 116 impacting against the shive material in the impact area 120 while still producing a fine powder of shive as output through the screen apertures 80 and then through the backing member openings 138. A suction force can be applied on the outlet side of the screen assemblies 78*a* and 78*b* to assist in drawing shive through the fine apertures 80.

As previously-mentioned, it is preferred to provide two rotary grinders 77 with the first grinder 77*a* providing an initial size reduction of the shive and the second grinder 77*b* providing the shive at its final size. In the preferred form, the first rotary grinder 78 has outlet apertures 80 of its screen assembly 78 that are in the range of 0.0125 inch to 0.0625 inch, and the second rotary grinder 77*b* has outlet apertures 80 of its screen assembly 78 that are in the range of 0.027 inch to 0.020 inch. Thus, the rotary grinder section 18 of the shive processing section 14 of the present plant material processing system 10 is effective to reduce the size of the shive by at least 90 percent as it comes from the oscillating sieves 82 and 84 and is fed to the rotary grinder 77, as previously discussed.

The shive processing portion of the system 10 can also be provided with a rotary screening section 140 downstream from the second grinder 77*b*. The rotary screening section 140 is provided with cylindrical or drum-shaped screens 142 and into which the ground up shive material is fed at an upstream end 144 thereof. The cylindrical screens 142 can be obtained from Forever out of Winnipeg, Manitoba in Canada, and in particular screen model number H-1S-144. The cylindrical screens 142 are arranged linearly in back-to-back arrangement with upstream open end 144 of initial drum screen 142 preferably being slightly higher than downstream open end 146 of the last drum screen 142 in the row. The screens 142 are provided with fine apertures similar in size or slightly less than the outlet apertures 80 of the screen assembly 78 of the second rotary grinder 77*b*. In this manner, the rotary screening section 140 can serve as a final particle size limiter, or as a safety backup in case of failure of a screen assembly 78 in the rotary grinders 77.

The cylindrical screens 142 are mounted to a rotor (not shown) for driving the screens 142 for rotation. The ground-up shive material is fed into the interior of the screens 142 at the vertically higher upstream end 144. Rotation of the cylindrical screens 142 is effective to expose more of the screen surface to the shive material fed therein. As the shive particles sift through the screen 142 they fall into a bottom hopper 148 which collects the powdered shive and conveys it into storage silos 150. On the other hand, the shive material and any foreign objects therewith that are not sifted through the cylindrical screens 142 exit from the lower downstream end 146 and are conveyed back into inlet 118 of the first rotary grinder 77*a* for regrinding and are thereby recirculated through the grinding section 18 and then through the rotary screening section 140 of the shive processing portion 14 of the present processing system 10. In this manner, a continuous loop is provided so that substantially all of the shive material from the flax straw fed to the system 10 herein is ground to the fine predetermined size desired for commercial applications.

Figure 13:
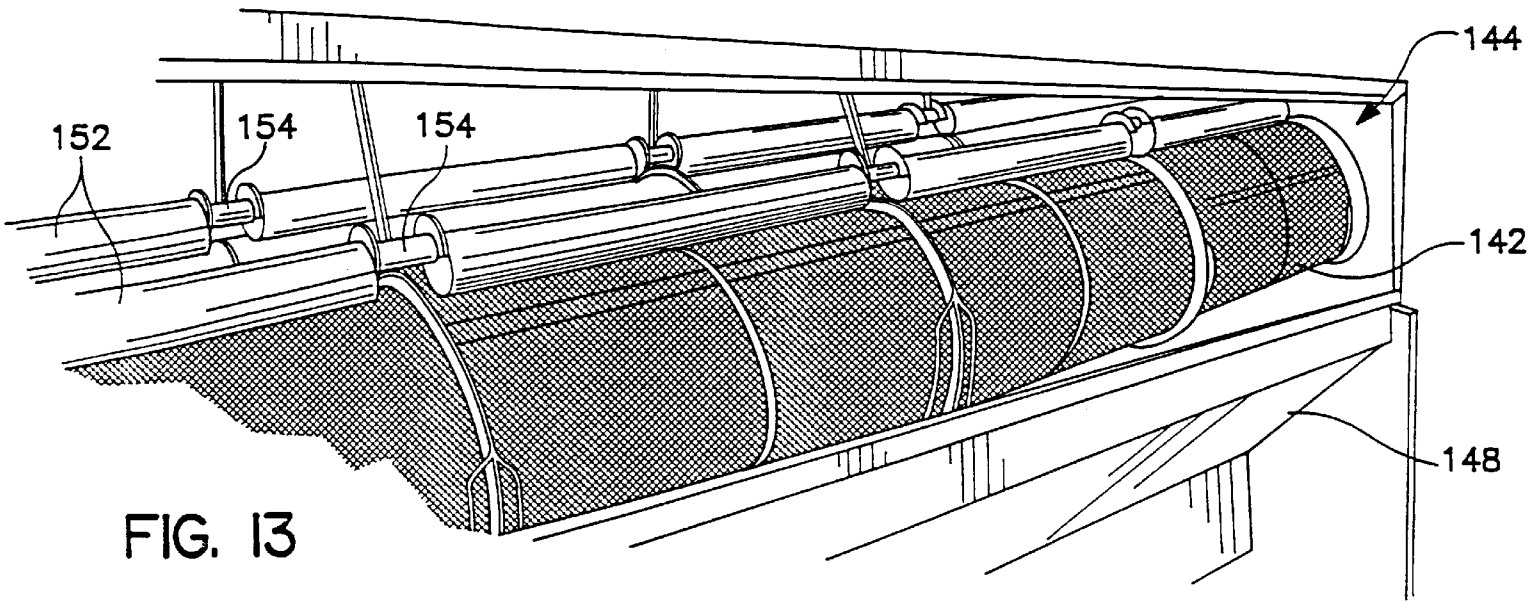
FIG. 13 is a perspective view of rotary cylindrical screens of a rotary screening section of the shive processing portion of the plant processing system with the cylindrical screens arranged to be inclined from upstream downwardly to a downstream end thereof.

For handling greater volumes of shive, two rows of cylindrical screens 142 can be provided side by side, as depicted in FIG. 13. In addition, each of the rows of cylindrical screens 142 can have small diameter tubes 152 that are situated to rest on the exterior of the screens 142 by way of mounting rods 154 extending therein. The tubes 152 are freely rotatable about the rods 154 and can be of low friction plastic material such as PVC for ease of rotation thereon. As mentioned, the tubes 152 rest on the outer surface of the cylindrical screens 152 so that as the screens 142 rotate, the PVC tubes 152 will likewise rotate thereon. The tubes 152 serve to push any particles that only get part way out from the fine apertures of the cylindrical screens 142 back into the interior of the cylinder screens 142 so as to prevent plugging up of the screens 142 and thereby keeping them free for sifting shive material therethrough.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A system for processing plant material, the system comprising:

a plurality of plant material processing sections to which the plant material is subjected for separating woody portions from fibers of the plant material and for reducing the size of the separated woody portions, the processing sections including:

(a) a stripping section which exerts a pulling action on the plant material to strip woody portions of the plant material from the plant fibers to minimize damage to and shortening of the fibers;

(b) a cleaning section for separating the majority of the remaining of the associated woody portions from the plant fibers by scraping of the plant material to minimize damage to and shortening of the fibers; and (c) a downstream grinding section which receives woody portions that have been separated from the plant fibers and which rapidly beats and grinds the woody portions to a predetermined substantially smaller size when compared to the separated woody portions received from the stripping and cleaning sections.

2. The processing system of claim 1 further comprising a fiber recovery portion that has an oscillating sieve section for shaking and separating fibers from woody portions before the woody portions are fed to the grinding section.

3. The processing system of claim 1 wherein the processing sections further include a rotary screening section for sifting the woody portions after the woody portions have been subjected to the grinding section to produce ground up woody portions having a consistent predetermined fine size.

4. The processing system of claim 3 wherein the rotary screening section includes a generally cylindrical screen having a first end and a second end and the ground up woody portions are fed into the first end and rotation of the screen causes the woody portions having the predetermined fine size to pass through the screen and the larger remaining woody portions to exit at the second end of the cylindrical screen for rerouting back to the grinding section.

5. The processing system of claim 1 wherein the plant material fed to the stripping section has a length in the range of approximately 12 to 14 inches and the stripping section produces fibers having a length in the range of approximately 6 to 8 inches and after being subjected to the cleaning section the fiber length is reduced to be in the range of approximately 4 to 6 inches.

6. The processing system of claim 1 wherein the stripping section yields a fiber product that is in the range of approximately 55 to 60 percent fiber purity and the fiber product yielded by the cleaning section is further purified to approximately 90 percent fiber purity.

7. The processing system of claim 1 wherein the predetermined size of the woody portions produced by the downstream grinding section is approximately in the range of between 0.125 inch and 0.020 inch.

* * * * *